US009452812B2

(12) United States Patent
Aasebø et al.

(10) Patent No.: US 9,452,812 B2
(45) Date of Patent: Sep. 27, 2016

(54) PROPULSION UNIT FOR MARITIME VESSEL INCLUDING A NOZZLE EXHIBITING AN EXCHANGABLE LEADING EDGE ON THE INLET OF THE NOZZLE

(71) Applicant: Rolls-Royce Marine AS, Aalesund (NO)

(72) Inventors: Steinar Aasebø, Gursköy (NO); Rune Garen, Eiksund (NO)

(73) Assignee: Rolls-Royce Marine AS, Aalesund (NO)

( * ) Notice: Subject to any disclaimer, the term of this patent is extended or adjusted under 35 U.S.C. 154(b) by 0 days.

(21) Appl. No.: 14/764,009

(22) PCT Filed: Jan. 24, 2014

(86) PCT No.: PCT/NO2014/050014
§ 371 (c)(1),
(2) Date: Jul. 28, 2015

(87) PCT Pub. No.: WO2014/120019
PCT Pub. Date: Aug. 7, 2014

(65) Prior Publication Data

US 2015/0367921 A1 Dec. 24, 2015

(30) Foreign Application Priority Data

Jan. 31, 2013 (NO) ..... 20130165

(51) Int. Cl.

| | |
|---|---|
| ***B63H 5/15*** | (2006.01) |
| ***B63H 23/24*** | (2006.01) |
| ***B63H 21/30*** | (2006.01) |
| ***B63H 25/42*** | (2006.01) |

(52) U.S. Cl.
CPC ..... *B63H 5/15* (2013.01); *B63H 21/305* (2013.01); *B63H 23/24* (2013.01); *B63H 25/42* (2013.01)

(58) Field of Classification Search
CPC ..... B63H 5/15; B63H 21/305; B63H 23/24; B63H 25/42
See application file for complete search history.

(56) References Cited

U.S. PATENT DOCUMENTS

| | | | | |
|---|---|---|---|---|
| 4,789,302 | A | 12/1988 | Gruzling | |
| 5,220,231 | A | 6/1993 | Veronesi et al. | |
| 5,389,021 | A * | 2/1995 | Padgett | B63H 5/165 440/67 |
| 5,799,394 | A * | 9/1998 | Rice | B63H 5/14 29/889.1 |
| 2001/0029133 | A1* | 10/2001 | Breems | B63H 5/1252 440/6 |
| 2003/0235502 | A1* | 12/2003 | Van Dine | F04D 29/326 416/230 |
| 2011/0248118 | A1* | 10/2011 | Meekins | B64C 25/54 244/101 |
| 2012/0093668 | A1 | 4/2012 | Gieras et al. | |

FOREIGN PATENT DOCUMENTS

| | | |
|---|---|---|
| GB | 1472544 | 5/1977 |
| JP | S6228700 U | 2/1987 |
| WO | 2013137746 A1 | 3/2013 |
| WO | 2013169116 A1 | 4/2013 |

OTHER PUBLICATIONS

International Search Report and Written Opinion dated Apr. 23, 2014 (PCT/NO2014/050014).

* cited by examiner

*Primary Examiner* — Stephen Avila
(74) *Attorney, Agent, or Firm* — Alix, Yale & Ristas, LLP

(57) ABSTRACT

Propulsion unit for propulsion and maneuvering of a maritime vessel, including a nozzle provided with a sectioned leading edge on inlet of the nozzle, which leading edge is formed by sections of a low-weight non-metallic material, and a front ring, which front ring is arranged between main part of the nozzle and the sectioned leading edge and is arranged for providing a fastening point for the sections of the leading edge.

20 Claims, 10 Drawing Sheets

PROPULSION UNIT FOR MARITIME VESSEL INCLUDING A NOZZLE EXHIBITING AN EXCHANGABLE LEADING EDGE ON THE INLET OF THE NOZZLE

BACKGROUND

The disclosure relates to propulsion units for propulsion and maneuvering of a vessel provided with an exchangeable sectioned leading edge on the inlet of the nozzle.

There are known propulsion units including a propeller section which is fixed in a surrounding rotor part, in the periphery of which there are arranged permanent magnets or windings for providing magnetic field. The rotor part constitutes the rotor of an electrical motor and is positioned inside a surrounding stator part, which stator part is provided with magnetic devices or windings for generating magnetic field for causing rotation of the propeller section.

U.S. Pat. No. 5,220,231 discloses such a propulsion unit for a seagoing vessel. The propulsion unit has a centrally supported propeller section having propeller blades extending radially between a central part and a radially exterior positioned ring which rotates with a small radial distance from the stator part.

It is an increasing focus on reducing the power requirement for the use of all types of propulsion units for propulsion and maneuvering of a vessel. There are increasing demands for emission of environmentally unfriendly gases and the fuel costs are increasing, something which have resulted in increased focus on development of new solutions, among others, optimization of propeller blades and development of hybrid systems for propulsion of the vessels.

Propulsion units are further provided with a leading edge on the inlet of the nozzle to provide it with a hydrodynamic design. Presently, the most propulsion units being produced and used are provided with a leading edge being integrated in the nozzle itself. This makes the nozzle unnecessary heavy, and the hydrodynamic design is permanent and cannot be changed. This results in that all propulsion units must be custom-made to the actual vessel they are to be used on, and it results in more expensive production of the propulsion units.

In GB1472544 it is disclosed a solution where both the leading edge and the following edge are exchangeable or controllable. The leading edge can be sectioned along the circumference and shaped of a different material than the main part of the nozzle, such as plastics or glass fibers. Disadvantages with this publication are, among others, that the leading edge and following edge are arranged to be fixed in the extension of the nozzle itself, which nozzle then must exhibit an open end on each side. This results in that the leading or following edge must either be welded or it must be fixed both from the inside and outside of the nozzle. By that the leading and following edges must be arranged in the extension of the nozzle like this, this result in that nozzles cannot be mass-produced, but must be custom-made to the individual vessel. Further, by that the leading and following edges are arranged in the extension of the nozzle, this will result in that there is a danger for leakage into the nozzle, especially if the leading or following edge is made of plastics or glass fibers. Further, if the leading and following edges are adjustable, this will be a disadvantage, especially as the adjustment means for this (holes and screws) could result in that the leading or following edge changes design after some time of use, so that the propulsion unit exhibits a different profile than originally intended. This can then result in unfavorable operating conditions for the propulsion unit. It is further not indicated any type of propulsion unit this solution can be utilized on, as it will be a central point how e.g. the propulsion unit is to be arranged to the vessel and how the propeller section is designed.

It is also an increasing focus on providing propulsion units having lower weight, are more rapid and simple to handle under production, and cheaper in relation to prior art solutions. Even though the propulsion unit should have lower weight it is important that it exhibits sufficient strength.

SUMMARY

The disclosure provides a propulsion unit for propulsion and maneuvering of a vessel which solves the above mentioned disadvantages with prior art.

The disclosure provides a propulsion unit, preferably a rotatable propulsion unit, having lower weight compared to prior art.

The disclosure provides a propulsion unit having a simplified assembly process by that the leading edge on the inlet of the nozzle of the propulsion unit, i.e. the hydrodynamic design, can be mounted in the end.

The disclosure provides a propulsion unit where the leading edge on the inlet is easily exchangeable so that one easily can change hydrodynamic design of the leading edge if desirable or necessary due to changed operating profile or damages.

The disclosure provides a propulsion unit where the leading edge on the inlet of the nozzle is sectioned in several parts, so that each part becomes easy to handle and produce.

The disclosure provides a propulsion unit having tangentially varying length by that the propulsion unit is provided with a sectioned leading edge formed by sections having different length in axial direction.

The disclosure provides a propulsion unit where the leading edge is formed by sections having different shape/design (profile) for therethrough to exhibit varying length in tangential direction.

The disclosure provides a propulsion unit where sections of the propulsion unit have different shape/design and length for therethrough to compensate for varying inflow velocity.

The disclosure provides a propulsion unit where at least one part of the sectioned leading edge on the inlet of the nozzle is made of a low-weight non-metallic material, something which will contribute to lower total weight, and simplify handling and production.

The disclosure provides a propulsion unit where the entire sectioned leading edge is formed by a low-weight non-metallic material.

The disclosure provides provide a propulsion unit where arrangement of stays for the propeller section is integrated in the sectioned leading edge.

The disclosure provides fastening means for arrangement of stays for holding the propeller section are hidden behind the sectioned leading edge.

Disclosed herein is a propulsion unit for propulsion and maneuvering of maritime vessels, which is adapted for fastening to hull of the vessel or a steering device arranged for rotating the propulsion unit 0-360 degrees, a limited number of degrees, pivotable movement of the propulsion unit, swinging the propulsion unit in/out of the hull of the vessel or similar.

The propulsion unit includes a nozzle wherein a propeller section being electrically or hydraulically driven is arranged for propulsion and maneuvering of the vessel.

The propulsion unit further includes a fastening device in the form of one stem extending from an upper surface of the nozzle and up in the hull of the vessel or steering devices, or a fastening device which includes two stems extending in parallel or laterally reversed about an vertical central axis from an upper surface of the nozzle of the propulsion unit ending in a fixing device for thereby providing an opening which provides the propulsion unit with improved hydrodynamic performance.

The propeller section of the propulsion unit can be arranged in several ways. By use of stays in front and/or behind or by that the propeller section is periphery-supported.

The disclosed propulsion unit is further provided with a leading edge which can be adapted for simplified assembly process of the propulsion unit by that the leading edge on the inlet of the nozzle, i.e. the hydrodynamic shape, can be arranged in the end.

The leading edge is further arranged for being exchangeable, so that one can change the hydrodynamic shape of the leading edge if it is desirable or necessary due to changed operating profile or damages.

The leading edge is further preferably formed by several sections, so that each section becomes easy to handle and produce.

The leading edge can further be arranged for providing a nozzle with tangentially varying length by that the sectioned leading edge is formed by combining different design of different sections.

The leading edge can further be arranged for providing a nozzle with tangentially varying shape/design (profile) of the leading edge.

By that the leading edge of the nozzle is formed by different section having different shape/design and length one can compensate for varying inflow velocity to the propulsion unit.

At least one part of the leading edge is formed by a low-weight non-metallic material, such as Polyurethane (PUR) or similar, something which will contribute to lower total weight, and more easy handling and production.

The entire leading edge is preferably formed by a low-weight non-metallic material.

The leading edge can further be formed in different ways, which will be further described below.

In a first embodiment the leading edge is formed by a front ring being integrated with stays for supporting the propeller section, which stays extend from the periphery of the ring and towards the center of the ring and are connected to the hub at the other end of the stays. The leading edge further includes a sectioned part which forms the hydrodynamic shape of the inlet. The front ring is arranged for arrangement between the main part of the nozzle and the sectioned part forming the hydrodynamic shape of the inlet. The front ring is preferably of a metallic material, such as cast iron, structural steel or similar, while the sectioned part is entirely formed by a low-weight non-metallic material. The front ring is arranged for being fastened to the main part of the nozzle and arranged for providing a fastening point for the sections which form the leading edge, and for accommodating and distributing the forces from the stay and out to the main part of the nozzle and further up in the fixing device.

In addition the entire front ring in many cases will have supporting functions for periphery bearings, and a sealing function for the oil lying around the motor inside the nozzle.

The sections are provided with fastening means for fastening of the front ring and possibly mutual fastening.

In a second embodiment of the propulsion units having periphery supported propeller section, the leading edge is formed by a whole front ring, as the propulsion unit does not include stays. The leading edge further includes a sectioned part forming the hydrodynamic shape of the leading edge. A periphery supported propeller section is a bearing device where the stationary part of the bearing device is fixed to stator and the rotating part of the bearing device is fixed to rotor. The front ring is as above arranged for arrangement between the main part of the nozzle and the sectioned part forming the hydrodynamic shape of the inlet. The front ring is preferably of a metallic material, cast iron, structural steel or similar, while the sectioned part as a whole is formed by a low-weight non-metallic material. The front ring is provided with fastening means for fastening to the main part of the nozzle, while the sections are provided with fastening means for fastening to the front ring and possibly mutual fastening.

In a third embodiment one or more sections of the sectioned leading edge is/are integrated with stays for supporting the propeller section, which stays extend from the periphery of the leading edge and towards the center of the leading edge and connected to the hub at the other end of the stays. The sections of the leading edge not being integrated with stays are preferably formed by a low-weight non-metallic material. The sections are further provided with fastening means for fastening to the main part of the nozzle and possibly mutual fastening. The embodiment will be suitable for propulsion units where one do not need the above mentioned sealing function of the front ring. The sections in this embodiment will be provided with means for fastening to the nozzle, and possibly for mutual fastening.

The disclosed propulsion units incorporate fastening means for arrangement of stays, front ring or others be will thus hidden behind the leading edge, something which results in hydrodynamic advantages. Fastening means for stays and front ring are solid/large bolts, which are favorable to hide behind a hydrodynamic smooth surface. Resistance from e.g. bolts which protrude has directly negative influence on the efficiency of the propulsion unit, so it is important that elements do not protrude inside the nozzle. Elements protruding inside the nozzle will further result in turbulence and noise in the flow through the nozzle.

Further, one will by that the leading edge includes sections of a low-weight non-metallic material achieve a propulsion unit having lower weight compared to prior art.

Another moment which is important for rotatable propulsion units is that as little space as possible is required in connection with rotation (azimuth), something which can be solved by that the leading edge at the inlet of the nozzle is shortened in the outermost points, seen along a horizontal central axis through the nozzle, when the nozzle is seen from the front.

By that the sections of the leading edge exhibit different design one can provide a propulsion unit having a nozzle exhibiting a curved leading edge at the inlet of the nozzle. There can be several alternative designs, when the nozzle is seen from the front:

- the length of the nozzle is largest at the upper part of the nozzle and shorter in the remaining design of the nozzle,
- the length of the nozzle is largest at upper part of the nozzle and shortest at the outermost points of a horizontal central axis through the nozzle.

Generally, but not necessarily, it is advantageous that the length of the nozzle at lower part of the nozzle also is some longer than the shortest length.

The nozzle preferably exhibits a curved leading edge where the nozzle extends with a decreasing length from the foremost point towards the remaining design of the nozzle, such as towards the lower part of the nozzle. The nozzle is e.g. longest in upper part of the nozzle and extends with a decreasing length towards the outermost points of a horizontal central axis through the nozzle, for next to exhibit increasing length towards the lowest part which has some longer length than the shortest length of the nozzle.

By that the nozzle exhibits increased length in upper part of the nozzle one achieve a propulsion unit having larger inner space in upper part of the propulsion unit so that one e.g. can utilize stronger and more solid stays for accommodating forces so that one maintain an acceptable stress level in the materials of the nozzle and fastening device, something which will result in increased operating time and safety.

By a curved leading edge one further achieve reduced space when the propulsion unit is rotating under the hull, lower steering moment which is required for rotating the propulsion unit due to lower side forces acting on the propulsion unit, and that one achieve a propulsion unit having lower weight. This will result in that the propulsion unit can be dimensioned for lower steering moment. The lower steering moment the propulsion unit must be dimensioned for the smaller propulsion unit, something which will result in a cheaper propulsion unit.

By providing the propulsion unit with a curved leading edge on the nozzle this will not result in more variation in the load of the propeller section than what is normal, and will thus not affect noise and vibrations, and at the same time one achieves the above-mentioned advantages.

In other embodiments it is desirable with varying shape/length of the leading edge for compensating tangentially varying inflow velocity in towards the leading edge. How this variation of inflow velocity appears will vary from vessel to vessel, and this can easily be adapted in each separate case by that the leading edge is sectioned.

It is very typical that the inflow velocity is lowest at "12 o'clock", due to water boundary layer along the vessel. When the inflow velocity at a given point is low it is advantageous that the propulsion unit exhibits a nozzle having a longer nozzle profile and larger diameter in the foremost point of the leading edge (larger opening of the nozzle).

The following edge at the outlet of the nozzle can be arranged in the same way. This will also contribute to a propulsion unit having lower weight.

The disclosed propulsion unit contains components that are easy to handle and produce, and simpler to assemble.

It is further provided a propulsion unit having lower weight due to the use of non-metallic material.

It is further provided a propulsion unit which more easily can be adapted to the at each time existing specifications by that the leading edge in a simple manner can be exchanged when damaged or needed for changed operating profile.

BRIEF DESCRIPTION OF THE DRAWINGS

The disclosed device will now be described in further detail with references to the attached drawings, where.

DETAILED DESCRIPTION

Figure 1:
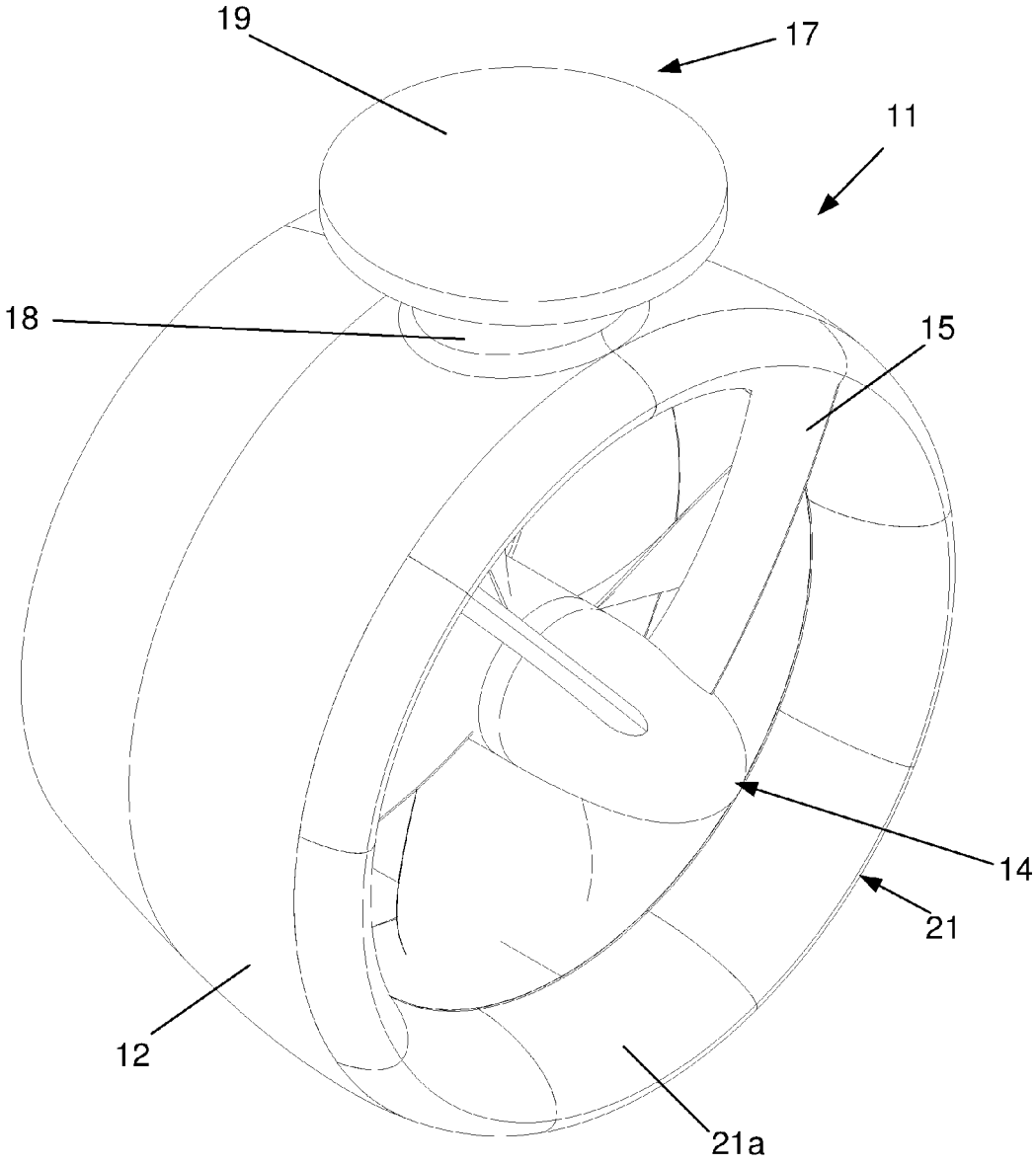
FIG. 1 is a perspective view, seen inclined from the front, of a propulsion unit for propulsion and maneuvering of a maritime vessel according to a first embodiment of the disclosed propulsion unit.
Figure 2:
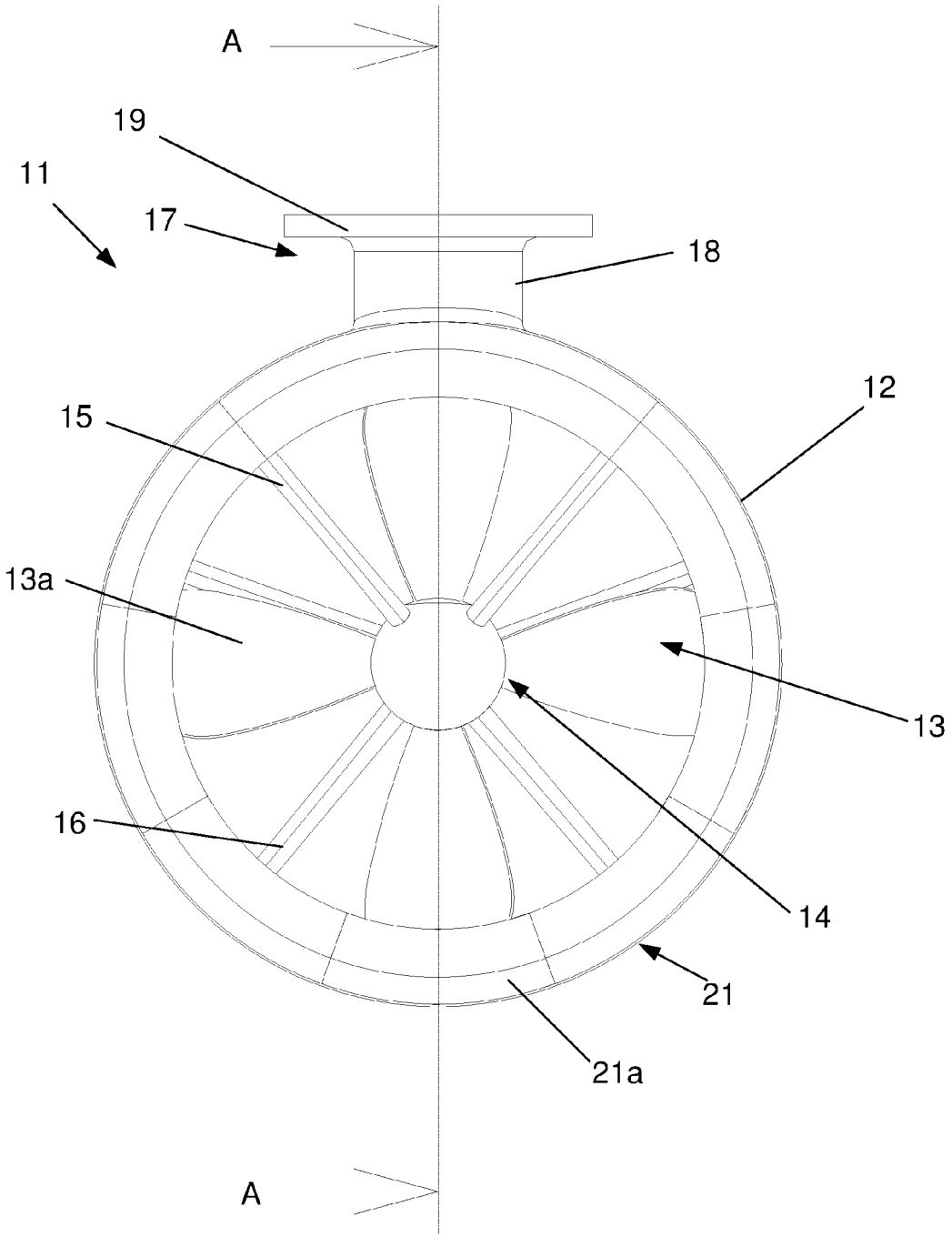
FIG. 2 shows a front view of the propulsion unit in FIG. 1.

Reference is now made to FIGS. 1 and 2 which show a first embodiment of a propulsion unit 11 for propulsion and maneuvering of a maritime vessel for arrangement to hull of the vessel or a steering device arranged for rotating the propulsion unit 0-360 degrees, tiltable movement, swinging the propulsion unit out of/into the hull of the vessel or similar. The propulsion unit 11 includes a tubular nozzle 12 with a propeller section 13 having a central hub 14 rotatably supported in the nozzle 12 by means of stays 15, 16, arranged in front and behind the hub 14, respectively, fixed to the nozzle 12. In the shown embodiment there are used two stays 15 in front and five stays 16 behind, but the number of stays in front and behind can of course be different from this. The main function of the stays 15, 16 is to accommodate forces.

As can be seen in FIG. 2 the propeller section 13 includes e.g. four propeller blades 13*a*, but it can of course include more or fewer propeller blades. The propeller blades 13*a* extend mainly radially between the central hub 14 and an annular rotor part (not shown) surrounding the propeller section 13, and to which the propeller blades 13*a* are fixed. The annular rotor part is rotatably arranged inside a stator part (not shown), preferably in a recess in the nozzle 12 so that the rotor parts are positioned outside the flow of water through the nozzle 12. A number of permanent magnets are arranged to the outer periphery of the rotor part. The permanent magnets are positioned a short distance from a plurality of windings fixed to the stator part, in such a way that magnetic fields for force application onto the magnets can be generated by supplying electric current in the windings, for controllable and controlled rotation of the rotor part, and hence also the propeller section 13. Between the exterior surface of the rotor part and an opposite inner surface of the stator part, there will be a gap which will be filled with water when the propulsion unit 11 is submersed in water. There also exist solutions which utilize gas for replacing the water in the gap for achieving reduced loss in the gap. These features are well known within the technique.

Propulsion units 11 like these are further provided with a fastening device 17 for arrangement of the propulsion unit 11 to hull of the vessel or steering devices, as mentioned above.

The fastening device 17 according to a first embodiment includes one stem 18 being arranged to an upper surface of the nozzle 12 by means of suitable fastening means (not shown) and which is provided with a fixing flange 19 at the side which is to be connected to a fastening point on the hull or a steering device.

Figure 4:
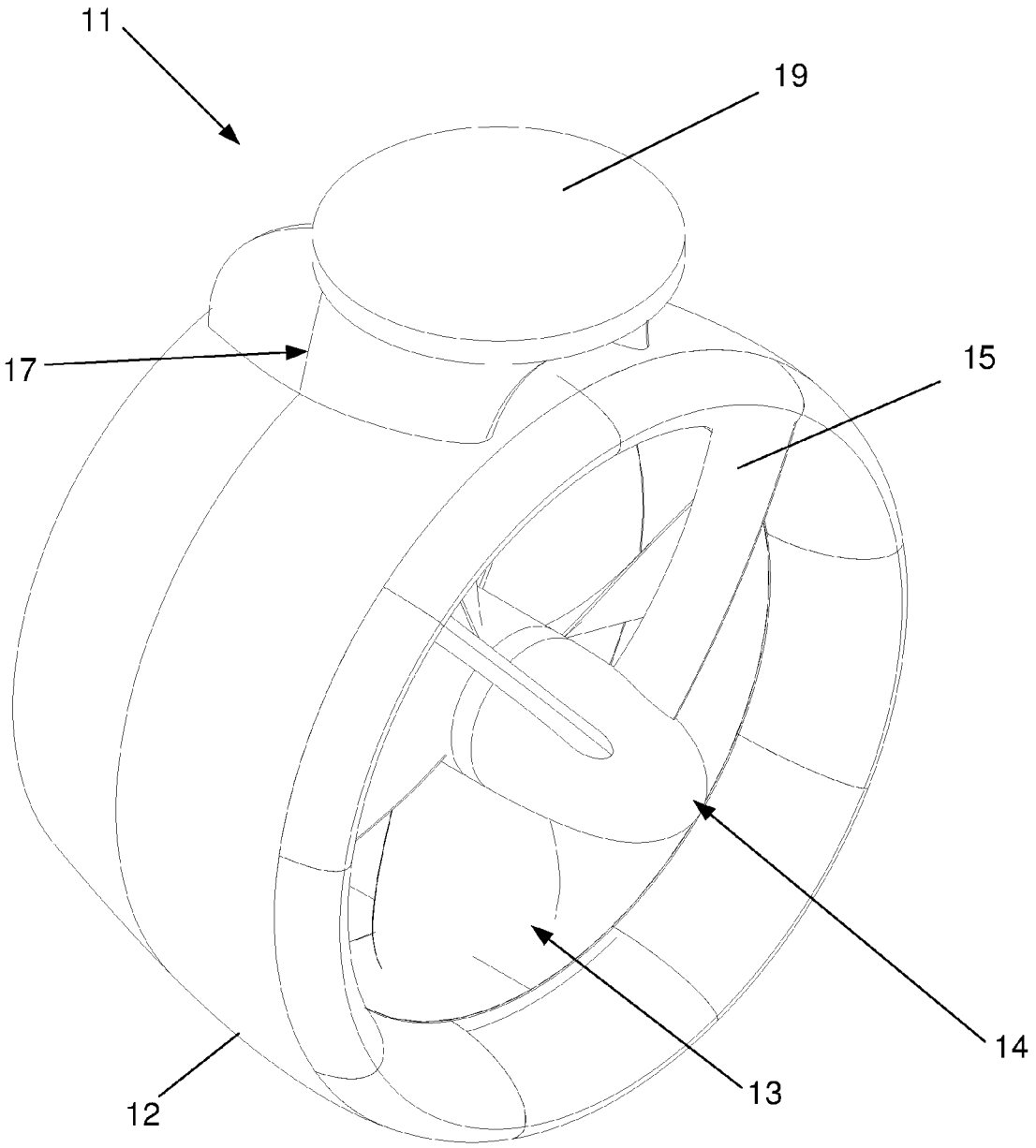
FIG. 4 is a perspective view, seen inclined from the front, of a propulsion unit for propulsion and maneuvering of a maritime vessel according to a second embodiment of the disclosed propulsion unit.
Figure 5:
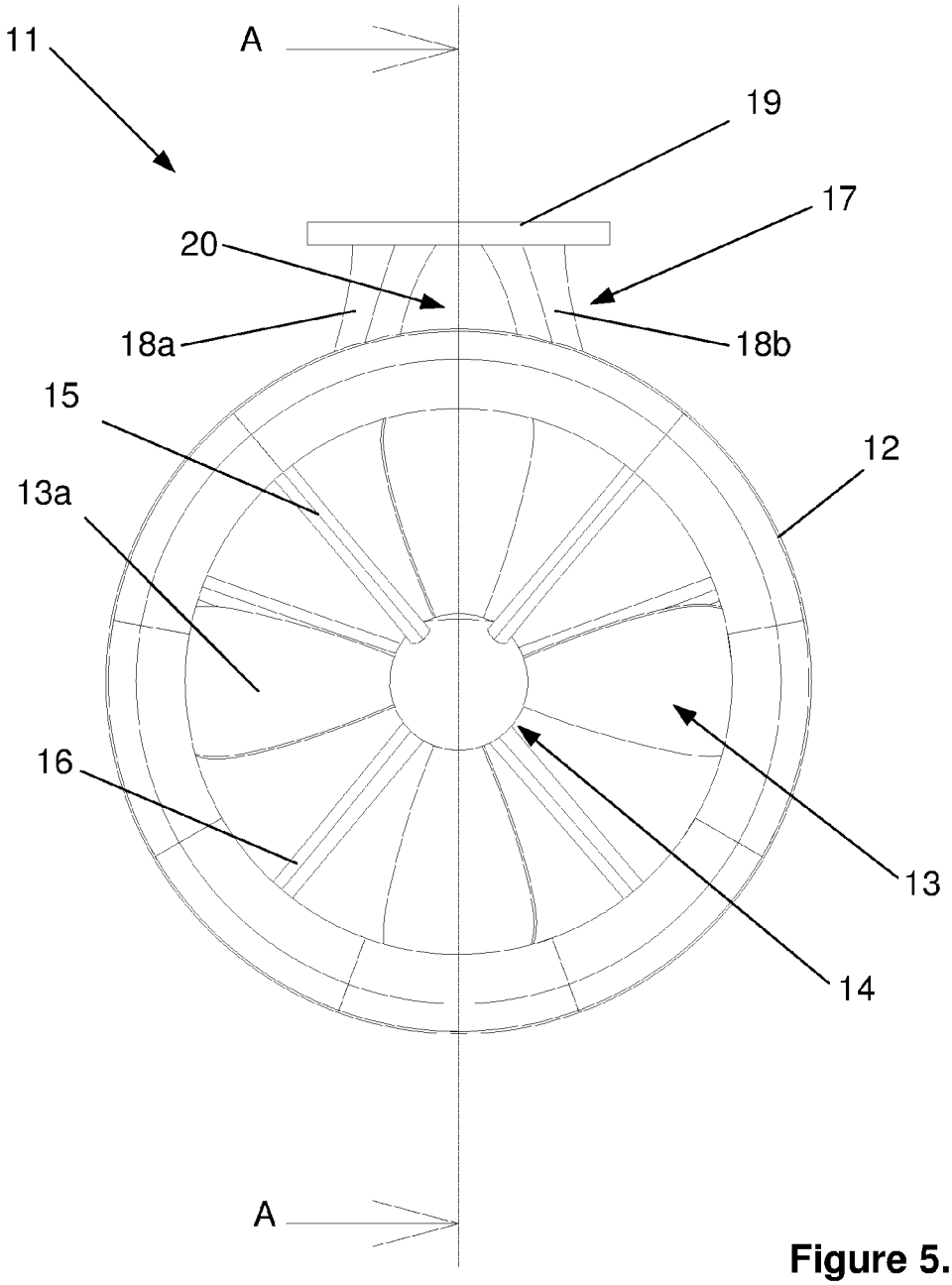
FIG. 5 shows a front view of the propulsion unit in FIG. 4.
Figure 6:
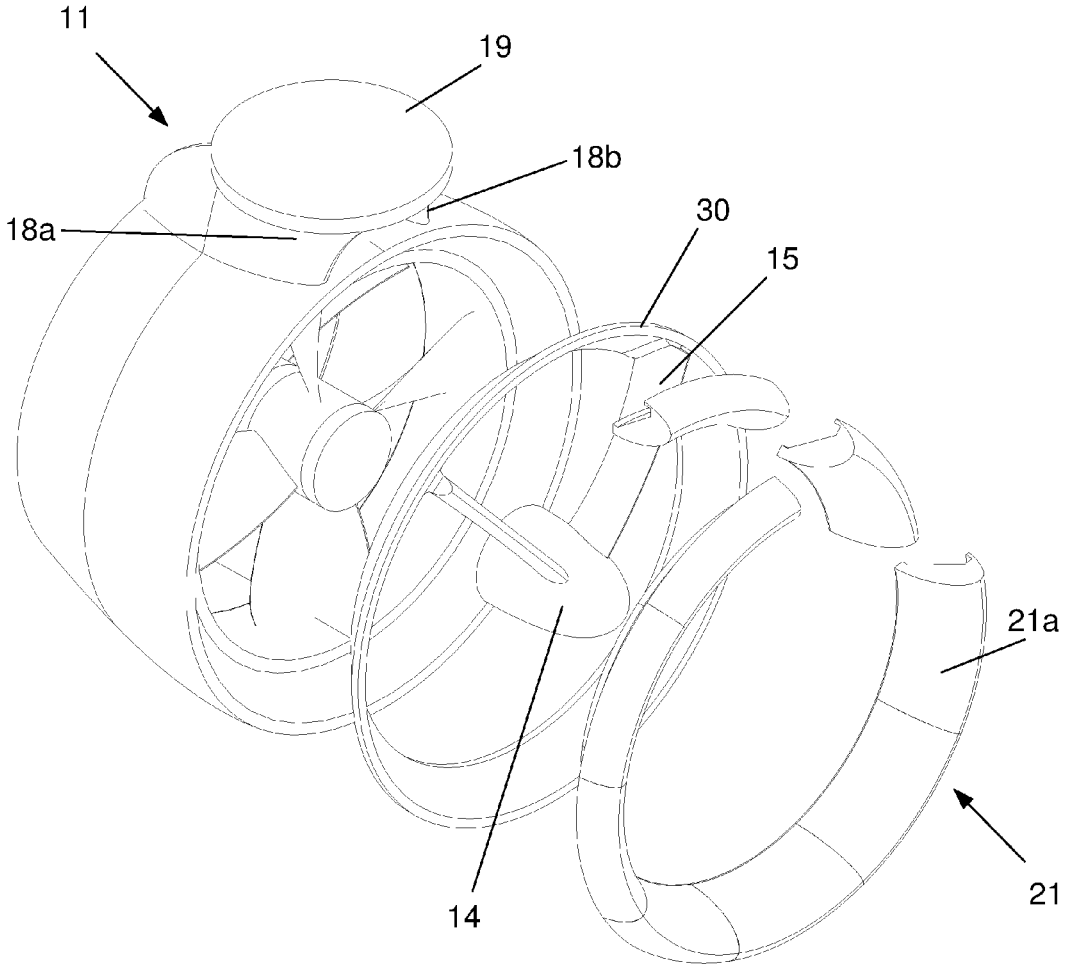
FIG. 6 shows an exploded perspective view of the propulsion unit in FIG. 4.

According to a second embodiment of the propulsion unit 11, as shown in FIGS. 4-6, the fastening device 17 includes two stems 18*a-b*, which stems 18*a-b* extend laterally reversed or in parallel about an vertical central axis (coincident with cross-sectional axis A-A indicated in FIG. 5), up from the nozzle 12 and ending in a fixing flange 19.

The stem 18/stems 18*a-b* preferably has/have a design which corresponds to a wing- or rudder-shape so that they are hydrodynamic optimal, so that they do not result in unnecessary turbulence, noise or vibrations.

In the embodiment with two stems 18*a-b*, the stems 18*a-b* and the fixing flange 19 will form an opening 20 (FIG. 5) above the nozzle 12 for allowing flow of water passing the outside of the nozzle 12.

It is further advantageous that the stem 18 of the first embodiment and the stems 18*a-b* of the second embodiment are arranged with a distance from the front of the nozzle 12 to avoid water which is passing on the outside of the nozzle 12 from hitting the stem(s) 18, 18*a-b* and being forced back and into the nozzle 12.

There are many advantages by using a fastening device 17 where two stems 18*a-b* ending in a fixing flange 19 are used so that a hydrodynamic opening 20 is formed. This will, among others, considerably reduce the generation of turbulent inflow at the top of the nozzle 12, something which will result in improved operating conditions for the propulsion unit 11 and due to this the propeller section 13 will achieve considerably improved efficiency, something which considerably will reduce the power requirement for powering the propulsion unit 11. Another advantage is reduced weight of the propulsion unit 11 by that there will be two stems 18*a-b* which will accommodate forces and vibrations such that one do not need a massive stem, and that these stems 18*a-b* together with the fixing flange 19 will provide a rigid construction. With only one stem, this will need to be dimensioned for all the forces and vibrations, something which thus will result in a heavier propulsion unit.

Figure 3:
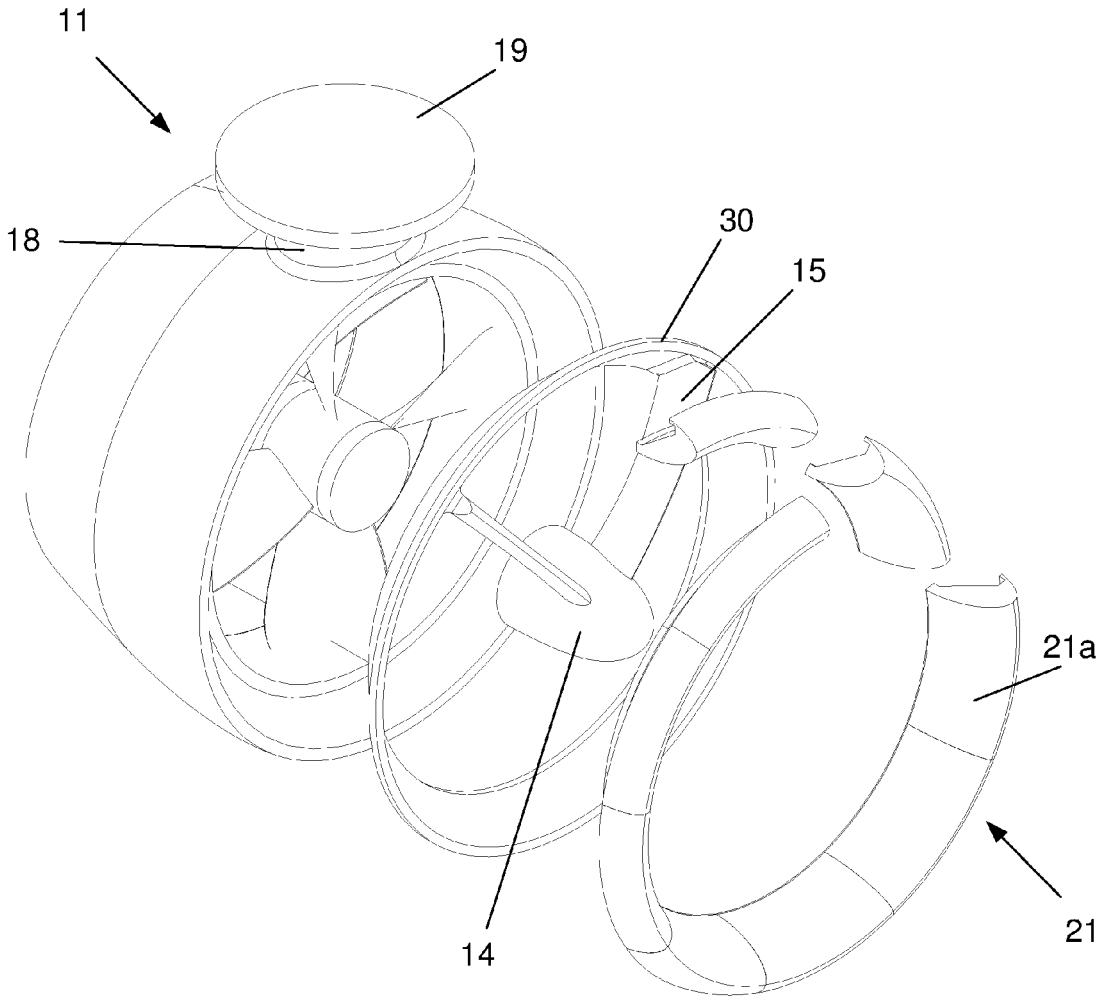
FIG. 3 shows an exploded perspective view of the propulsion unit in FIG. 1.

Reference is now made to FIGS. 1-3 for the first embodiment and FIGS. 4-6 for the second embodiment. According to the disclosure the propulsion unit 11 includes a nozzle 12 having a leading edge 21 on the inlet of the nozzle 12 formed by a low-weight non-metallic material, such as Polyurethane (PUR) or similar, which leading edge 21 is formed by sections 21*a* for easy handling and production. The leading edge 21 is preferably adapted for arrangement to the nozzle 12 in the end.

The leading edge 21 is further fixed to the nozzle by means of suitable means which makes it easily detachable and therethrough exchangeable, which results in that it is possible to change the hydrodynamic design (the hydrodynamic shape) of the leading edge 21 if it is desirable or necessary due to changed operating profile or damages. The propulsion unit 11 includes a front ring 30, as shown in FIGS. 3 and 6, to which front ring 30 the stays 15 in front of the propeller section 13 are arranged. The stays 15 are arranged to the front ring 30 by means of casting, welding, bolts or similar, and extend from the periphery of the front ring 30 and towards the center of the front ring 30 where the stays 15 are fixed to the hub 14. The front ring 30 is arranged between main part of the nozzle 12 and the sectioned leading edge 21 and is arranged for providing a fastening point for the sections 21 a of the sectioned leading edge 21. The front ring 30 is further arranged for distributing the forces acting on the stays into the hub 14 and out in the main part of the nozzle 12. The front ring 30 is further provided with fastening means (not shown) for arrangement to the main part of the nozzle 12. In this way the arrangement of the front ring 30 and thus the stays 15 will be hidden behind the leading edge 21. In the example it is shown two stays, but it is obvious that the number can vary depending on the application.

The sections 21*a* are further provided with fastening means (not shown) for arrangement to the front ring 30, and possibly mutual fastening.

As it is only hydrodynamic forces acting on the leading edge 21 of the nozzle 12, one can use a low-weight non-metallic material, such as Polyurethane (PUR) or similar, something which will contribute positively on the total weight, and also make handling and production easier.

The front ring 30 is formed by a metallic material, such as cast iron, structural steel or similar.

Figure 7:
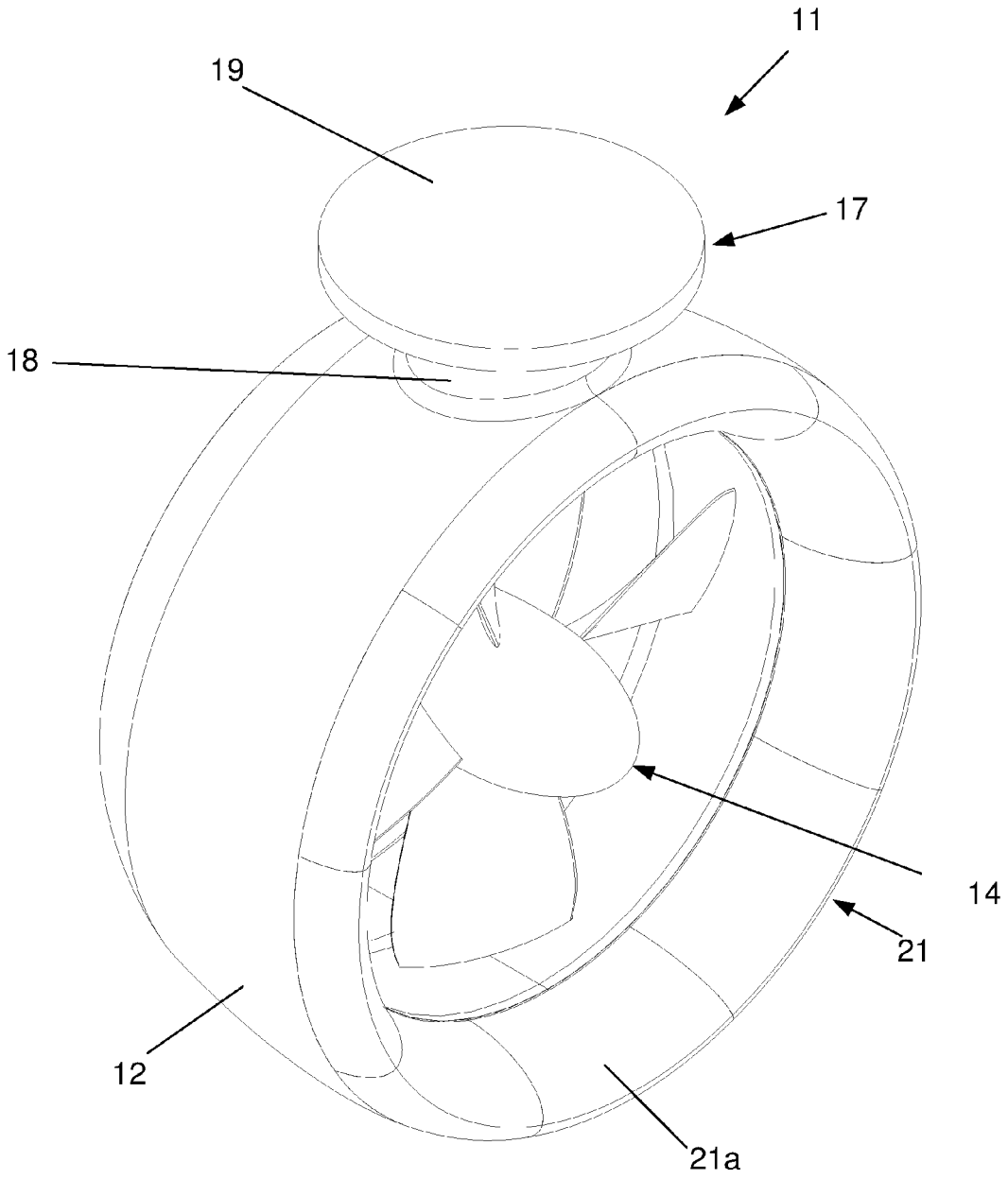
FIG. 7 is a perspective view, seen inclined from the front, of a propulsion unit for propulsion and maneuvering of a maritime vessel according to a third embodiment of the disclosed propulsion unit.
Figure 8:
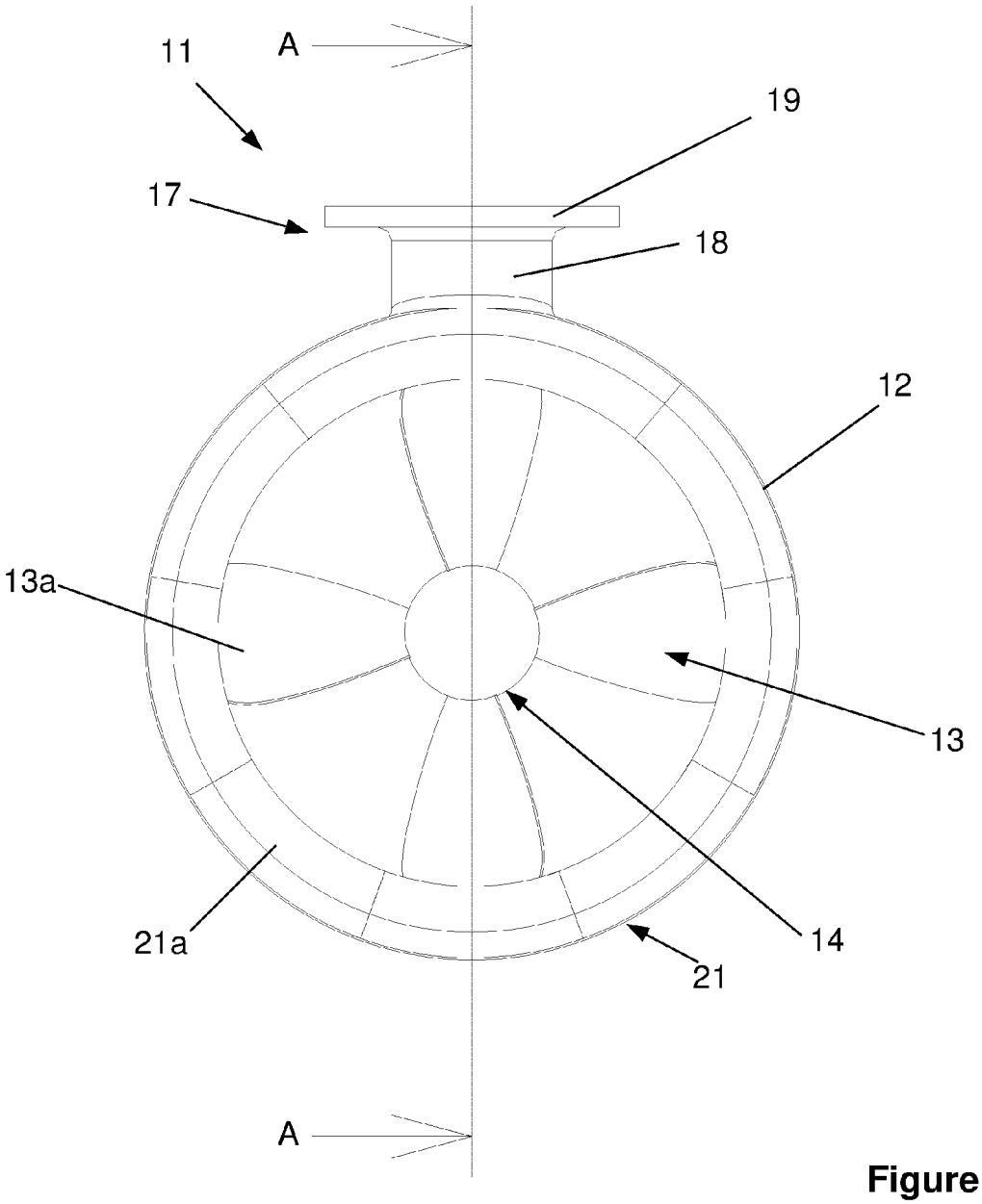
FIG. 8 shows a front view of the propulsion unit in FIG. 7.
Figure 9:
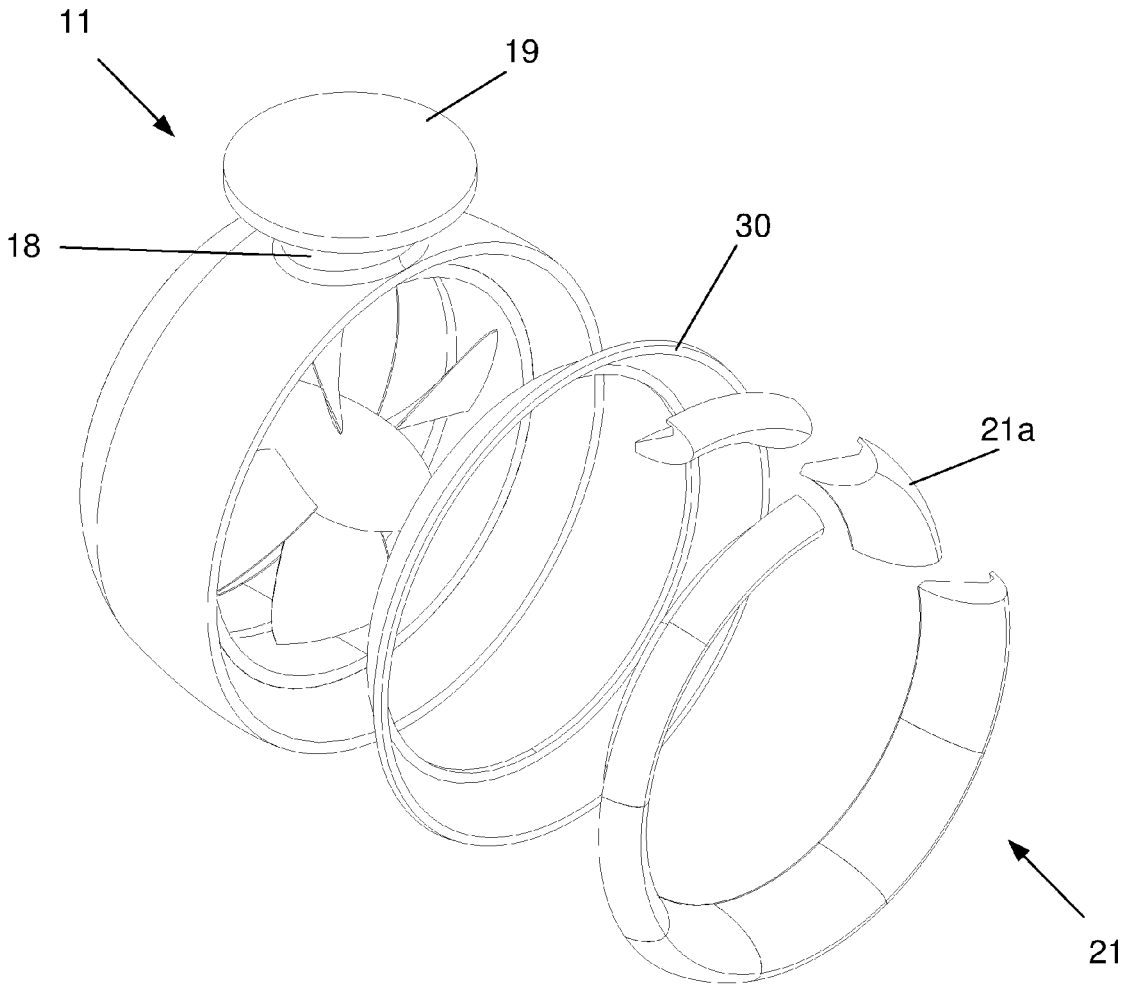
FIG. 9 shows an exploded perspective view of the propulsion unit in FIG. 7.

Reference is now made to FIGS. 7-9 showing a propulsion unit 11 according to a third embodiment, where the propulsion unit 11 includes a periphery-supported propeller section 13. In this embodiment the front ring 30 is a complete ring 30 without stays being arranged between the main part of the nozzle 12 and the leading edge 21 formed by sections 21*a*.

The remainder can be arranged in the same manner as described for the two first embodiments. The front ring 30 in this embodiment does not need to be dimensioned for stays and forces in connection with the stays, so that in this embodiment also the front ring can be made of a non-metallic material.

In the disclosed propulsion unit the front ring 30 has further the function of acting as a support for peripheral bearings, and a sealing function for the oil surrounding the motor in the nozzle.

The front ring 30 preferably exhibits an inclined profile which is adapted to an inner surface of the nozzle 12. Through this the joint between the leading edge 21 and the nozzle 12 at the inside can be drawn all the way back to the propeller section, something which will result in maximal weight saving. Exterior the joint between the leading edge and nozzle must be extended rather far forward on the nozzle due to the stem(s) of the nozzle are to be connected with parts of the nozzle being in metal, and for arrangement of the front ring to the nozzle in parts of the nozzle being in metal.

The front ring can also be made of sections for easier handling and production.

The leading edge 21/sections 21*a* is/are further shaped in such a way that it is adapted for arrangement to the front ring 30, and at the same time providing a smooth curved surface from the outer surface of the nozzle 12 and to the inner surface of the nozzle after the sections 21*a* are assembled to a leading edge 21 on the front ring 30. This results in that the fastening (bolts) of the front ring 30 and thus the stays become hidden behind the leading edge 21 formed by the non-metallic material.

Figure 10:
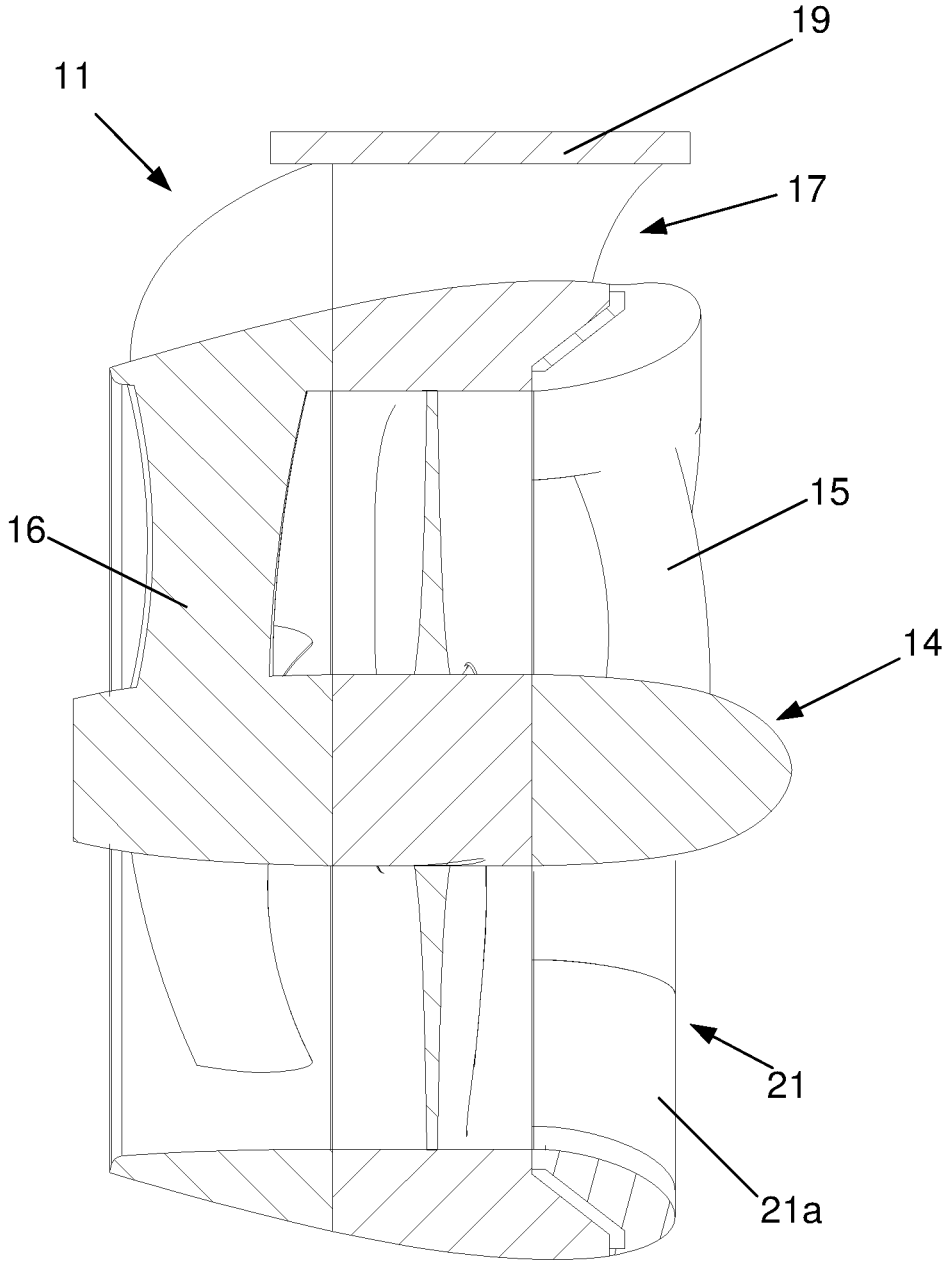
FIG. 10 is a cross-sectional view of a fourth embodiment of the disclosed propulsion unit.

Reference is now made to FIG. 10 showing a cross-sectional view of a fourth embodiment, which is an alternative design of the propulsion unit shown in FIG. 4. In the fourth embodiment the leading edge 21 exhibits tangentially varying length, which is provided by that the leading edge 21 is formed by sections 21*a* having a different design, such that when sections 21*a* are assembled to a continuous leading edge 21 the nozzle 12 exhibits a tangentially varying length. In the shown example the nozzle exhibits a curved leading edge where the length of the nozzle is longest at upper part of the nozzle 12 and has a decreasing length towards the lower point of the nozzle 12 for therethrough to compensate for lower inflow velocity in boundary layer of the water near the hull of the vessel.

The invention claimed is:

1. A propulsion unit (11) for propulsion and maneuvering of a maritime vessel having a hull, comprising:

a nozzle (12) provided with a sectioned leading edge (21) on an inlet of the nozzle (12), the leading edge (21) is formed by sections (21*a*) of a low-weight non-metallic material and a front ring (30), the front ring (30) is arranged between a main part of the nozzle and the sectioned leading edge (21) and provides a fastening point for the sections (21*a*) of the leading edge (21);

a propeller section (13, 13*a*) rotatably attached to the nozzle (12) about a hub (14) by means of stays (15, 16) or by periphery supports, the propeller section (13, 13*a*) is electrically or hydraulically driven; and a fastening device (17) attached to the hull of the vessel or a steering device arranged for steering or moving the propulsion unit (11).

2. The propulsion unit of claim 1, wherein the stays (15) in front of the propeller section (13) are integrated into the front ring (30).

3. The propulsion unit of claim 2, wherein the stays (15) are attached to the front ring (30) by means of casting, welding, or bolts and extend from the periphery of the front ring (30) towards the center of the front ring (30) where the stays are fixed to the hub (14).

4. The propulsion unit of claim 1, wherein the front ring (30) exhibits an inclined profile which is adapted to an inner surface of the nozzle (12) for forming a joint between the leading edge (21) and inner surface of the nozzle (12) positioned close to the propeller section (13), and for forming a joint between the leading edge (21) and nozzle (12) on outside thereof.

5. The propulsion unit of claim 1, wherein the front ring (30) is arranged to support peripheral bearings for the propeller section (30) and to seal for oil surrounding motor inside the nozzle (12).

6. The propulsion unit of claims 1, wherein the nozzle (12) exhibits a curved leading edge (21) such that an axial length of the nozzle (12) is longest at an upper part of the nozzle (12) and decreases towards a lower part of the nozzle (12).

7. The propulsion unit of claim 6, wherein the lower part of the nozzle (12) has a shorter length than the upper part of the nozzle.

8. The propulsion unit of claims 1, wherein the nozzle (12) exhibits a curved leading edge (21), such that an axial length of the nozzle (12) extends with decreasing length from an upper part to outermost points of a horizontal central axis through the nozzle (12) and with increasing length from the outermost points of the horizontal axis through the nozzle (12) to a lower part of the nozzle (12).

9. The propulsion unit of claims 1, wherein the nozzle (12) includes a leading edge (21) having a tangentially varying design.

10. The propulsion unit of claim 1, wherein the sections (21*a*) are provided with fastening means for attachment to the front ring (30).

11. The propulsion unit of claim 1, wherein the sections (21*a*) are provided with fastening means for mutual attachment to one another.

12. The propulsion unit of claim 1, wherein the fastening device (17) is formed by one or two stems (18, 18*a-b*) ending in a fixing flange (19), the stems (18, 18*a-b*) are wing or rudder-shaped such that they are hydrodynamically optimal to avoid unnecessary turbulence, noise, or vibrations.

13. The propulsion unit of claim 12, wherein the two stems (18*a-b*) extend in parallel or laterally reversed from an upper part of the nozzle (12) of the propulsion unit, the stems (18*a-b*) and a fixing flange (19) form an opening (20) which provides the propulsion unit (11) with improved hydrodynamic performance.

14. A propulsion unit (11) for propulsion and maneuvering of a maritime vessel having a hull, comprising:

a nozzle (12) provided with a sectioned leading edge (21) on an inlet of the nozzle (12), the leading edge (21) is formed by sections (21*a*) of a low-weight non-metallic material and at least one section (21*a*) of metal;

a propeller section (13, 13*a*) rotatably attached to the nozzle (12) about a hub (14) by means of stays (15, 16), the propeller section (13, 13*a*) is electrically or hydraulically driven, the stays (15) extend from the periphery of the leading edge (21) towards a center of the leading edge (21) and are connected to the hub (14) at the opposite end of the stays (15); and a fastening device (17) attached to the hull of the vessel or a steering device arranged for steering or moving the propulsion unit (11);

wherein at least one section (21*a*) of metal is integrated with said stays (15) in front of said propeller section (13).

15. The propulsion unit of claims 14, wherein the nozzle (12) exhibits a curved leading edge (21) such that an axial length of the nozzle (12) is longest at an upper part of the nozzle (12) and decreases towards a lower part of the nozzle (12).

16. The propulsion unit of claims 14, wherein the nozzle (12) exhibits a curved leading edge (21), such that an axial length of the nozzle (12) extends with decreasing length from an upper part to outermost points of a horizontal central axis through the nozzle (12) and with increasing length from the outermost points of the horizontal axis through the nozzle (12) to a lower part of the nozzle (12).

17. The propulsion unit of claims 14, wherein the nozzle (12) includes a leading edge (21) having a tangentially varying design.

18. The propulsion unit of claim 14, wherein the sections (21*a*) are provided with fastening means for mutual attachment to one another.

19. The propulsion unit of claim 14, wherein the fastening device (17) is formed by one or two stems (18, 18*a-b*) ending in a fixing flange (19), the stems (18, 18*a-b*) are wing or rudder-shaped such that they are hydrodynamically optimal to avoid unnecessary turbulence, noise, or vibrations.

20. The propulsion unit of claim 14, wherein the sections (21*a*) are provided with fastening means for attachment to the nozzle (12).

* * * * *